US005320035A

United States Patent [19]

Sanchez et al.

[11] Patent Number: 5,320,035

[45] Date of Patent: Jun. 14, 1994

[54] SUGAR CANE JUICE EXTRACTOR

[75] Inventors: Alfredo J. Sanchez; Rafael E. Sanchez, Jr., both of West Palm Beach; Charles J. Stemmann, Jr., Palm Springs, all of Fla.

[73] Assignee: Salus Corporation, West Palm Beach, Fla.

[21] Appl. No.: 802,065

[22] Filed: Nov. 27, 1991

[51] Int. Cl.[5] ..... B30B 15/14; B30B 9/20

[52] U.S. Cl. ..... 100/53; 99/341; 100/121; 100/131; 100/162 R; 100/172; 127/2; 127/43; 241/36; 241/37.5; 241/159; 312/138.1

[58] Field of Search ..... 127/2, 43; 241/159, 241/36, 37.5; 99/341; 312/138.1; 100/53, 104, 121, 131, 155 R, 161, 162 R, 166, 167, 172; 72/238, 239

[56] References Cited

U.S. PATENT DOCUMENTS

| | | | |
|---|---|---|---|
| 24,781 | 7/1859 | Paynter | 100/172 X |
| 1,844,877 | 2/1932 | Wentzel | 100/162 R |
| 2,004,056 | 6/1935 | Pipkin | 127/2 X |
| 2,613,118 | 10/1952 | Tippet | 100/162 R X |
| 2,704,975 | 3/1955 | Kaplan | 100/121 |
| 2,713,819 | 7/1955 | Lingle | 100/53 X |
| 3,049,074 | 8/1962 | Mellin | 100/162 R |
| 3,207,063 | 9/1965 | Major | 100/121 X |
| 3,269,302 | 8/1966 | Manaster | 100/171 X |
| 4,570,536 | 2/1986 | Dodd | 100/53 |

OTHER PUBLICATIONS

Three photographs labeled as Prior Art of a Sugar Cane crusher, no date.

*Primary Examiner*—Stephen F. Gerrity
*Attorney, Agent, or Firm*—Quarles & Brady

[57] ABSTRACT

An improved sugar cane juice extractor has removable crushing rollers. The juice extractor preferably includes a housing with a juice extracting compartment and a closure for accessing the compartment. The closure is preferably a clear plate which permits viewing of the compartment during operation and, when removed, allows access to the compartment for removal of the crushing rollers and cleaning of the rollers and the compartment. A safety switch can be provided to prevent rotation of the rollers when the closure is displaced. A guide into the compartment is preferably provided to direct the sugar cane and any flavorings into the crushing rollers. A waste channel is provided for the exit of crushed cane pulp.

15 Claims, 7 Drawing Sheets

SUGAR CANE JUICE EXTRACTOR

BACKGROUND OF THE INVENTION

1. Field of the Invention

The present invention relates to juice extraction apparatus, and more particularly to sugar cane juice extraction apparatus.

2. Description of the Prior Art

Sugar cane juice extractors are often used commercially in a setting where juice is squeezed to order for individual consumers, such as at a fair or in a retail store. Sugar cane juice extractors generally have a plurality of powered crushing rollers. Sugar cane stalks are passed through adjacent pairs of the rollers, crushing the stalks and separating a fresh, drinkable juice from the remaining pulp. The crushing rollers are bulky and positioned closely to each other, making cleaning difficult. The housing is usually made of several assembled parts with many edges and crevices where dirt may accumulate, further rendering cleaning difficult. Improper or incomplete cleaning can lead to unsanitary conditions.

Presently available sugar cane juice extractors do not allow observation of the operation of the crushing rollers in the juice extracting compartment. Viewing this operation allows the operator to observe the condition of the rollers and the compartment, alerting the operator when there is a jam or when cleaning is necessary. Further, observation of the operation is an attraction for customers, who can watch the preparation of fresh juice.

It is sometimes desirable to enhance the flavor of sugar cane juice by adding fresh ginger, lemon, or some other flavoring. It is difficult, however, to introduce these ingredients to the crushing rollers due to the small relative size and a tendency of the flavoring to fall away from the rollers unless held in place.

SUMMARY OF THE INVENTION

It is an object of the invention to provide a sugar cane juice extractor which facilitates the cleaning of the extractor, and thus improves the sanitation of the device.

It is another object of the invention to provide a sugar cane juice extractor which will permit viewing of the juice extracting operation.

It is yet another object of the invention to provide a sugar cane juice extractor which will permit the introduction of added ingredients for inclusion into the sugar cane juice beverage.

It is still another object of the invention to provide a sugar cane juice extractor which will be easy to operate.

It is another object of the invention to provide a sugar cane juice extractor which will provide improved safety in operation.

These and other objects are accomplished by a sugar cane juice extractor having a plurality of crushing rollers that are substantially adjacent one another and counter-rotating so as to pull the sugar cane stalk between the rollers. The stalk will be crushed and the juice separated from the sugar cane pulp. The crushing rollers are preferably provided in a compartment within a housing. Entry and exit ports are provided for the sugar cane stalk, and an outlet is provided for the juice. A guide is preferably provided to direct the sugar cane stalk from the entry port to the crushing rollers.

The crushing rollers are removable to permit cleaning of the rollers and the juicing compartment. An access opening is provided in the housing to permit removal of the crushing rollers from the compartment, preferably by hand. A suitable closure is provided, such as a hinged door or a removable cover shield. The closure can be clear to permit viewing of the operation of the juice extractor by the operator and by the customer. A safety switch is preferably provided to discontinue operation of the crushing rollers when the closure has been moved to the open position, to prevent injury.

BRIEF DESCRIPTION OF THE DRAWINGS

There are shown in the drawings embodiments which are presently preferred, it being understood, however, that the invention is not limited to the precise arrangements and instrumentalities shown, wherein.

DETAILED DESCRIPTION OF THE PREFERRED EMBODIMENTS

Figure 1:
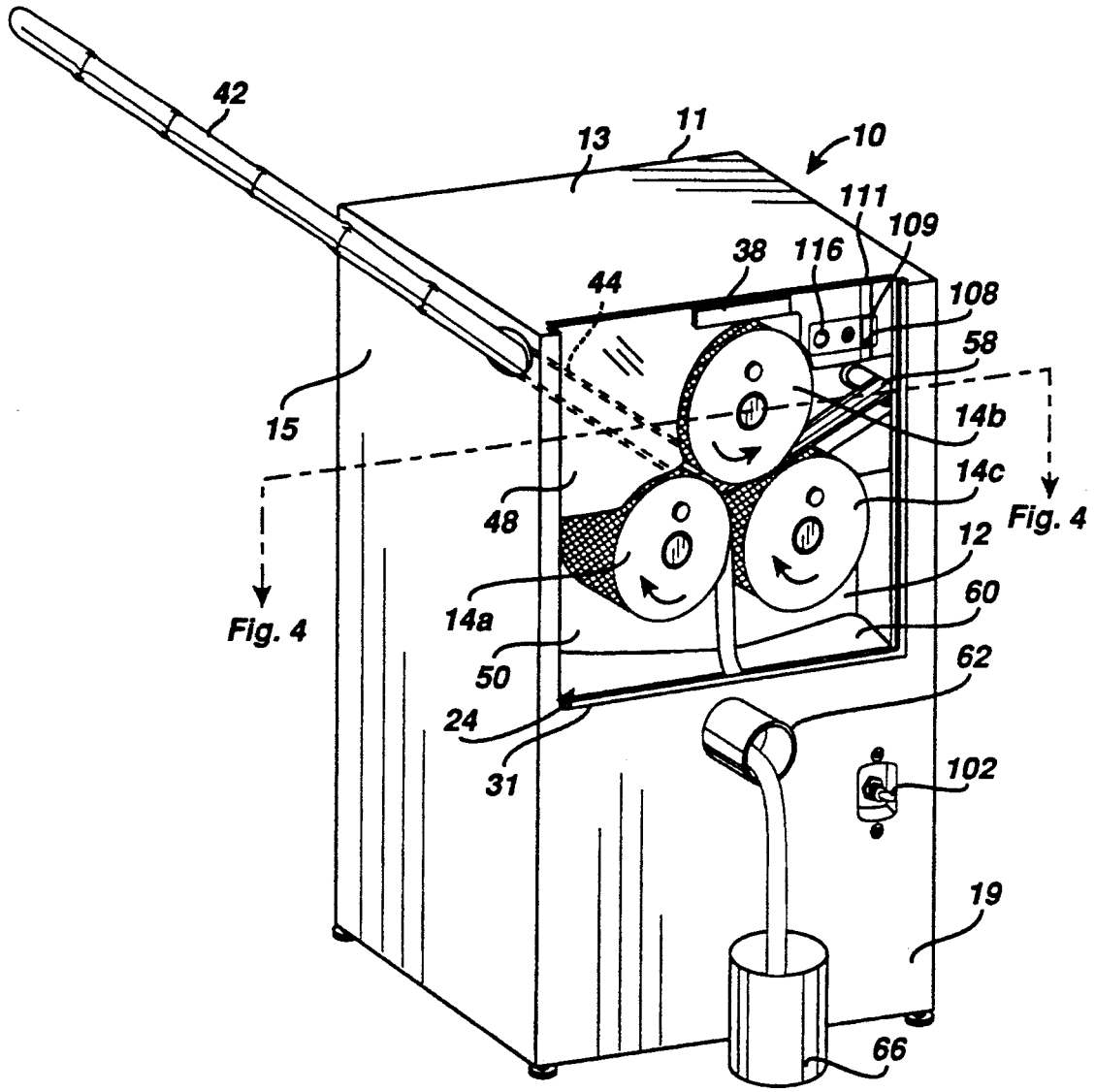
FIG. 1 is a left front perspective of a juice extractor according to the invention.

A juice extractor 10 according to the invention preferably comprises a housing 11 having an open internal juice extracting compartment 12. The housing 11 can take many configurations, including the depicted rectangular configuration with top 13, sides 15 and 17, front 19, rear 21 and base 23. A plurality of crushing rollers 14 are mounted in the compartment 12 in close proximity to adjacent rollers, and in counter-rotating fashion, to provide a construction which will crush the sugar cane stalk in the manner depicted in FIG. 1 so as to separate juice from the crushed pulp.

The crushing rollers 14 are removable from the compartment 12 to permit cleaning of the rollers 14 and of the compartment 12. The rollers 14 can be removably mounted within the compartment 12 by suitable structure such as the drive shafts 16. The rollers 14 have substantially axial openings 27 adapted to receive the shafts 16 to permit engagement of the crushing rollers 14 on the shafts 16. Suitable structure can be provided to prevent slippage of the crushing rollers 14 on the shafts 16. One such structure is a spline or key 20 on each shaft 16 which is adapted to mate with a corresponding slot 29 formed in the axial opening 27 of each roller 14. The key/slot construction permits the rollers 14 to be removed and replaced by hand, by sliding the roller axially off of and onto the respective drive shaft and key. Other structure, such as set screws and the like, is alternatively possible.

Figure 2:
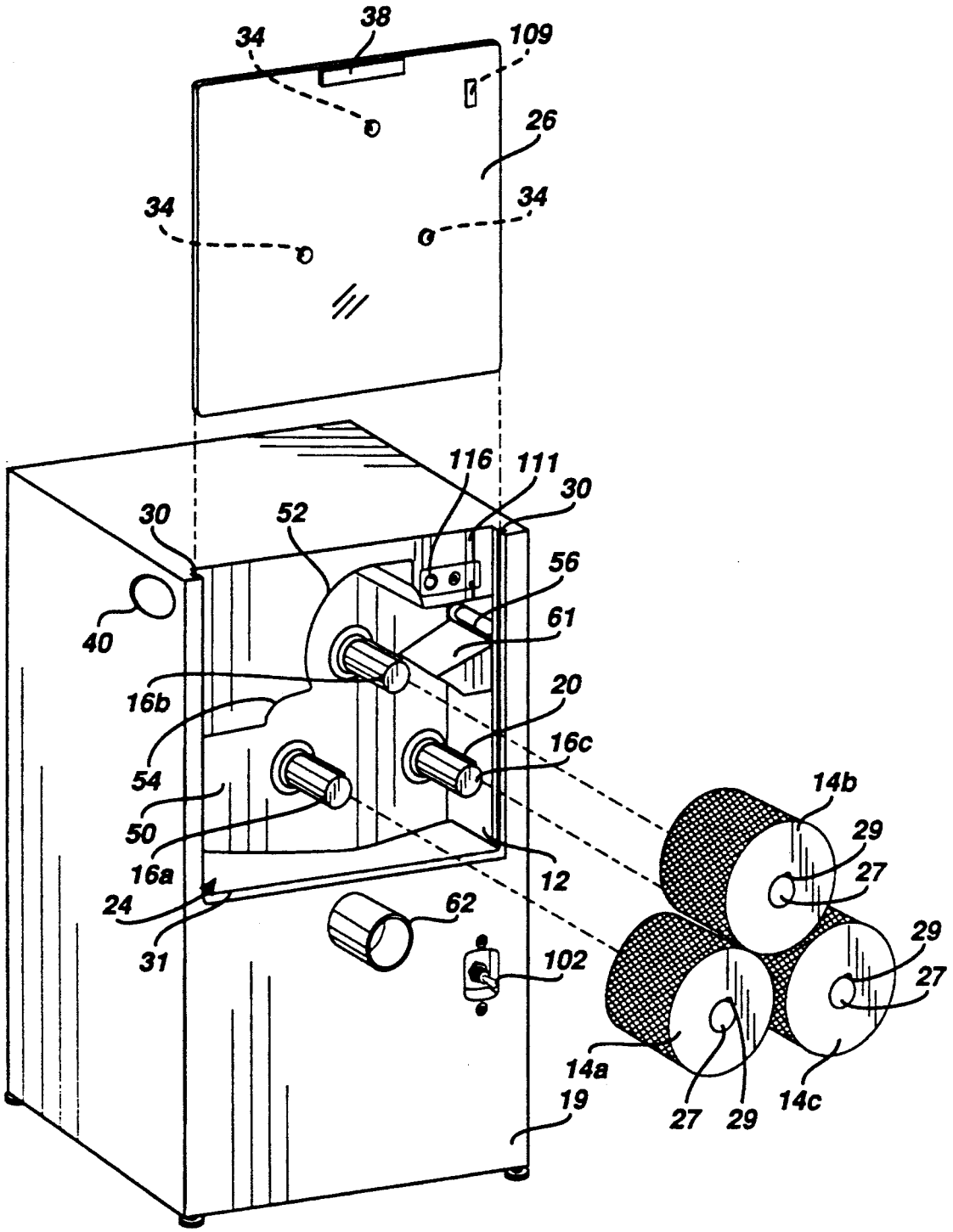
FIG. 2 is an exploded view of the perspective of FIG. 1.
Figure 3:
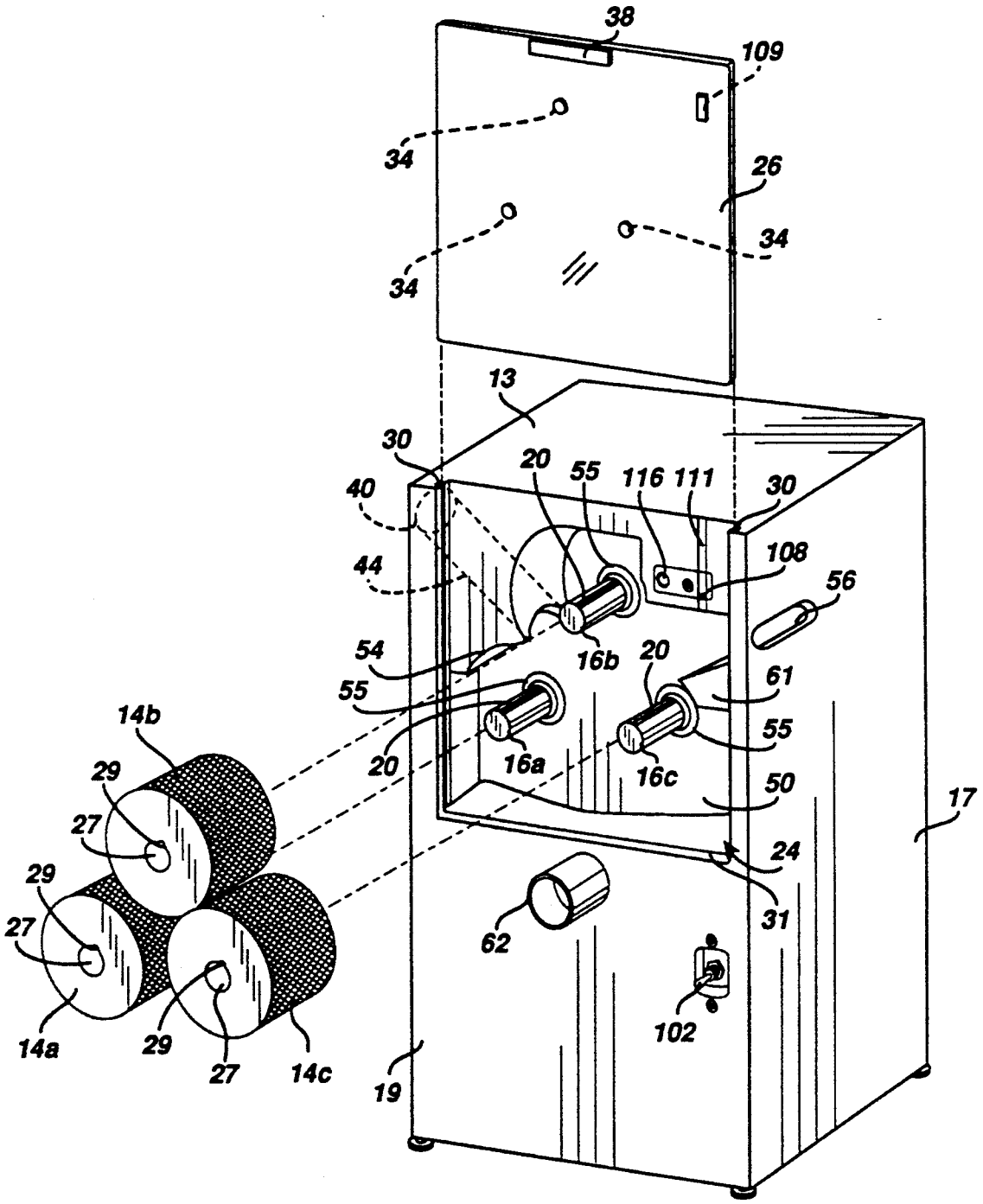
FIG. 3 is an exploded right front perspective.
Figure 4:
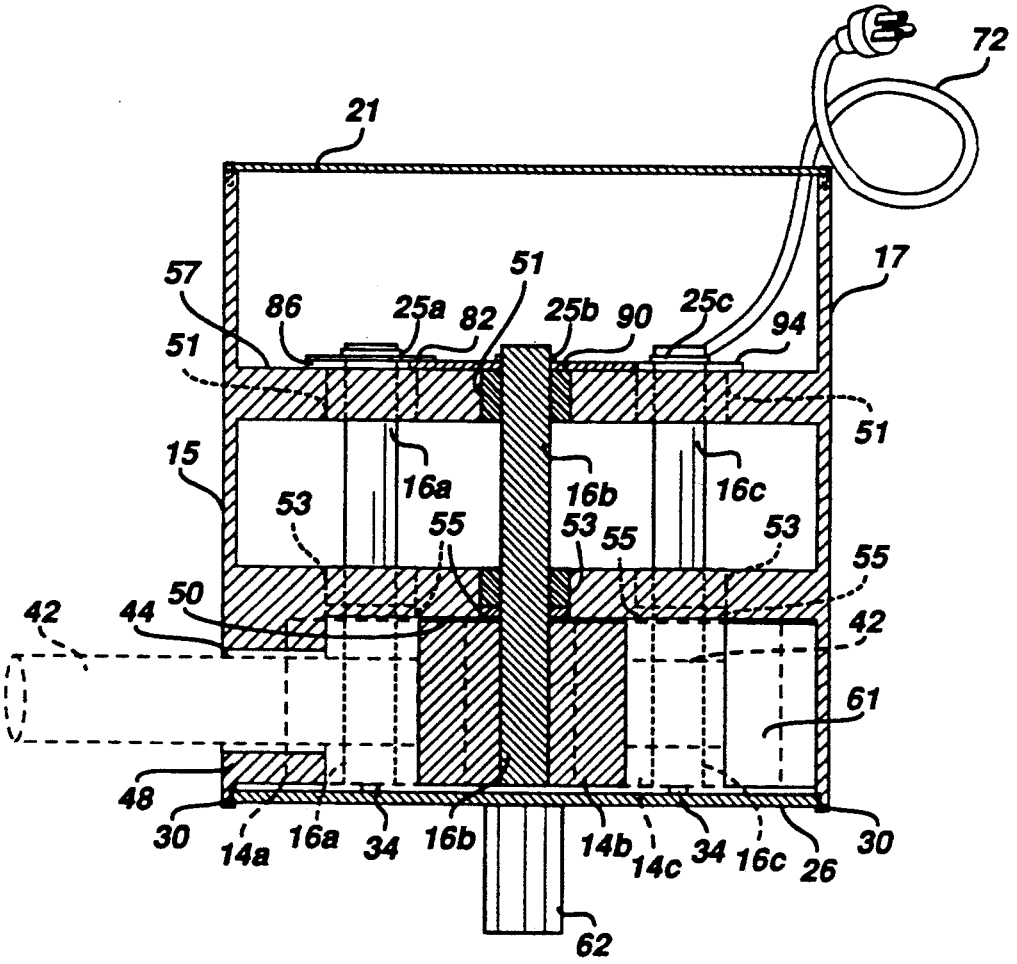
FIG. 4 is a cross-section taken along line 4—4 in FIG. 1.

An opening 24 in the housing 11 is provided to permit access to the compartment 12 and removal of the crushing rollers 14. A suitable closure for the opening 24 is provided, such as the cover 26. The cover 26 can be openable by several known structures, or completely removable. The cover 26 is most preferably removable. One suitable construction provides slots 30 in the front 19 of the housing 11 at sides of the opening 24, which slots receive the cover 26 in sliding fashion as depicted in FIG. 2. This construction provides a sealing action when the cover 26 is fitted into the slots 30 to prevent the escape of splashing juice. The base of the opening 24 is preferably formed by a ledge with an external lip 31, but the interior lip of the slot is omitted in this portion to permit juice to run back into the compartment 12

The cover 26 is preferably clear to permit viewing of the juice extracting operation within the compartment 12. This will enable the operator to determine if there are problems, and will also enable customers to view the preparation of a sugar cane juice beverage. Spacer elements 34 can be provided on an interior surface of the cover 26 to contact the rollers 14 should the rollers slip forward on the shafts 16. The elements 34 are preferably made of a low-friction material, such as polytetrafluoroethylene. A handle 38 can be provided on an exterior surface of the cover 26 to facilitate manipulation.

Sugar cane can enter the compartment 12 through an entry port 40 formed in the housing 11. A guide 44 can be provided to direct the stalk 42 to the proper position between adjacent crushing rollers 14*a* and 14*b*. A solid block 48 of material can extend forward from a back face 50 of the compartment 12 toward the opening 24. The solid block construction is more easily cast and reduces the number of corners and crevices in which dirt and food can accumulate. The guide 44 can be provided as a bore or channel through the block 48. The guide 44 also permits the introduction of small pieces of food additives such as ginger or lime when the sugar cane stalk is crushed to produce a flavored beverage. The block 48 is formed with contoured surfaces 52, 54 to provide a close fit with the installed rollers 14. The close tolerance of these surfaces with the crushing rollers 14*a* and 14*b*, together with the guide channel 44, ensure that the additive will not be displaced and will be included in the beverage product. An exit port 56 can be provided, as in the side 17 of the housing 11, for the passage of crushed pulp 58 from the compartment 12. A guide ramp 61 can be provided to direct the crushed pulp 58 through the exit port 56.

In a most preferred embodiment, three crushing rollers 14*a–c* are provided in a substantially triangular arrangement within the compartment 12. The sugar cane stalk 42 passes first between rollers 14*a–b* where it is partially crushed, and successively between the rollers 14*b–c* where the crushing operation is completed. The spacing between a first pair of rollers 14*a,b* is greater than the spacing between the second pair of rollers 14*b,c*, such that crushing will be effected in stages for more efficient juice extraction.

Juice extracted in the compartment 12 collects in a concave bottom portion 60 of the compartment 12, which is contoured so as to direct the juice to an outlet 62. Juice leaving the outlet 62 can be collected in a suitable container 66.

Operation of the crushing rollers 14 is provided by suitable drive apparatus. The shafts 16*a–c* preferably extend through the rear face 50 of the compartment 12 to a rear, drive compartment 68. Suitable structure such as nuts 25*a–c* secure the drive shafts 16*a–c*. Bearings 51 and 53 can be utilized to provide a reduced friction mounting. Seals 55 are coupled to the shafts 16 and separate the bearings 53 from the juice compartment 12.

Figure 5:
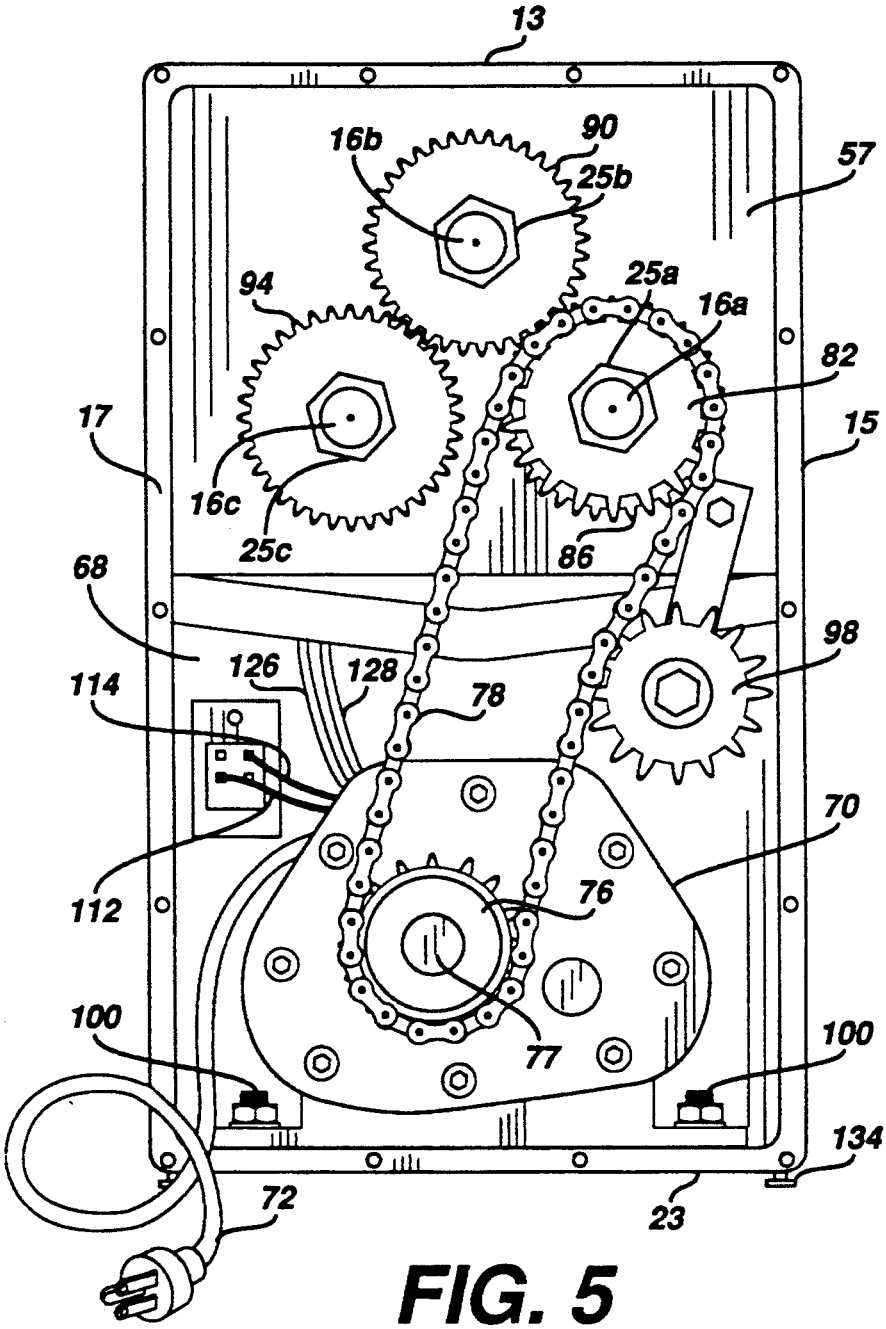
FIG. 5 is a rear elevation with a rear panel removed.
Figure 6:
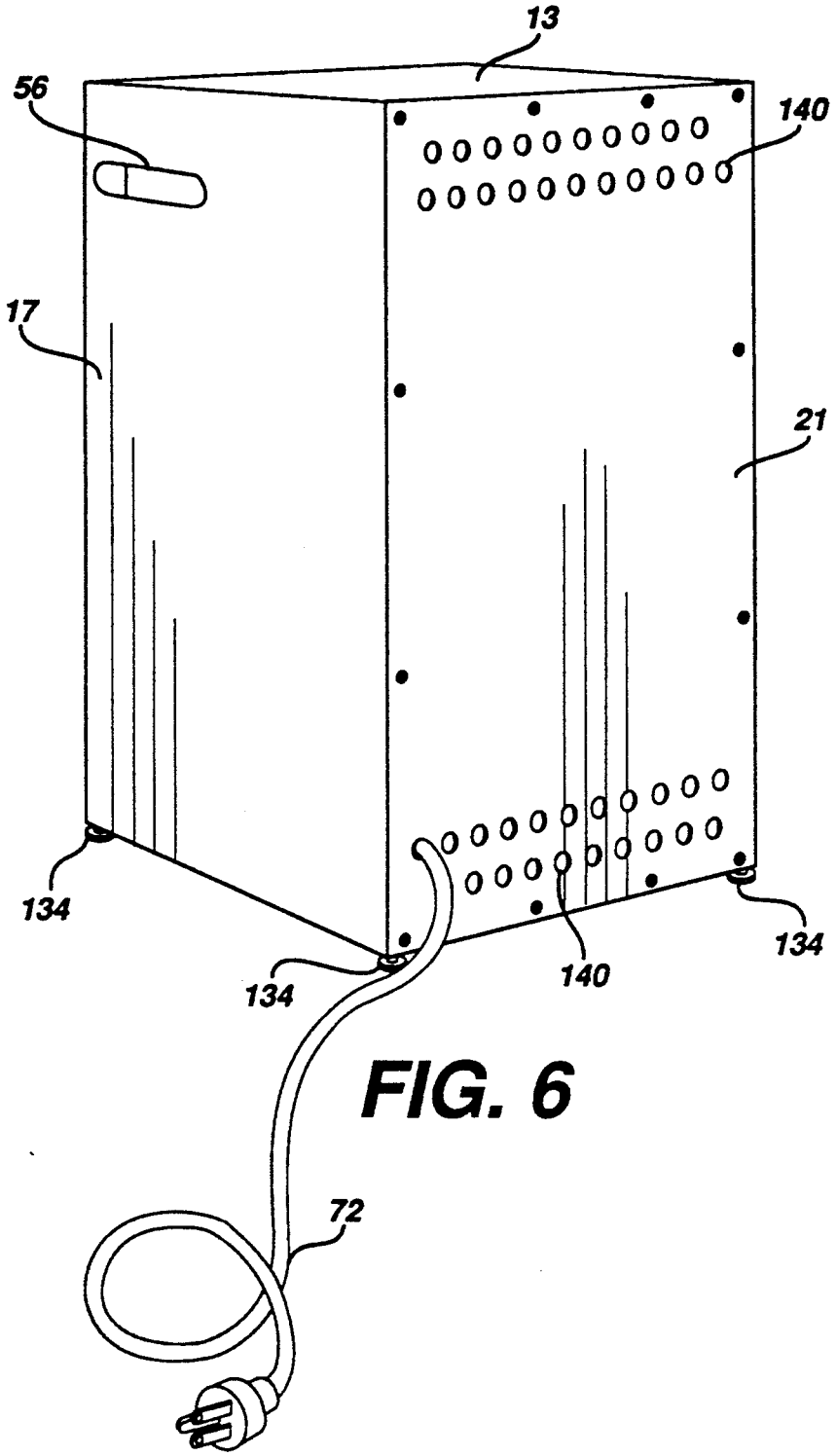
FIG. 6 is an assembled rear perspective.

A motor 70 is provided and can be powered electrically, as through a cord 72. The manner by which power from the motor 70 is transferred to the rollers 14 can vary. In one embodiment (FIG. 5), a drive sprocket 76 is connected to the drive shaft 77 of the motor 70. A drive chain 78 extends between the sprocket 76 and a sprocket 82. The sprocket 82 is coupled to the shaft 16*a*. A spur gear 86 is also coupled to the sprocket 82 and meshes with a spur gear 90 that is coupled to the shaft 16*b*. A spur gear 94 is coupled to the shaft 16*c* and meshes with the spur gear 90. Rotation of the drive sprocket 76 will cause similar rotation of the sprocket 82, shaft 16*a* and the corresponding crush 14*a*. Rotation of the spur gear 86 with the shaft 16*a* will cause counter-rotation of the spur gear 90 and shaft 16*b*, and thus also of the crushing roller 14*b*. Similarly, meshing of the spur gear 94 with the spur gear 90 will cause counter-rotation of the spur gear 94, shaft 16*c*, and roller 14*c*, with respect to the spur gear 90 and roller 14*b*. In this manner, the rollers 14*a,b* will be caused to counter-rotate, and the rollers 14*b,c* will also be caused to counter-rotate to provide a sequential crushing assembly.

The motor 70 is preferably a one-quarter horsepower 12 rpm gear motor which is reduced at the sprocket 82 to 8 rpm. A chain guide and tensioning gear 98 can be provided if desired. The motor 70 can mount to the housing by suitable structure such as bolts 100. It is desired that the shafts rotate at substantially the same rate so that movement of the sugar cane stalk through the extractor will be smooth. The use of spur gears 86, 90, and 94 of the same diameter and gearing is therefore desirable. The roller 14*a* is smaller in diameter than the rollers 14*b,c* to allow for greater distance between the first pair of rollers 14*a,b*. In a preferred embodiment, the roller 14*a* is about 3.6 inches in diameter. The rollers 14*b,c* are about 3.9 inches in diameter. The spacing between the rollers 14*a,b* is about 0.3 inches, and the spacing between the roller pair 14*b,c* is about 0.1 inches. The rollers 14 are preferably manufactured from stainless steel. The rollers should preferably have a surface to assist in gripping the sugar cane stalk. This surface can be provided by a coating, or by altering the surface of the roller, such as providing a knurled surface 48.

Figure 8:
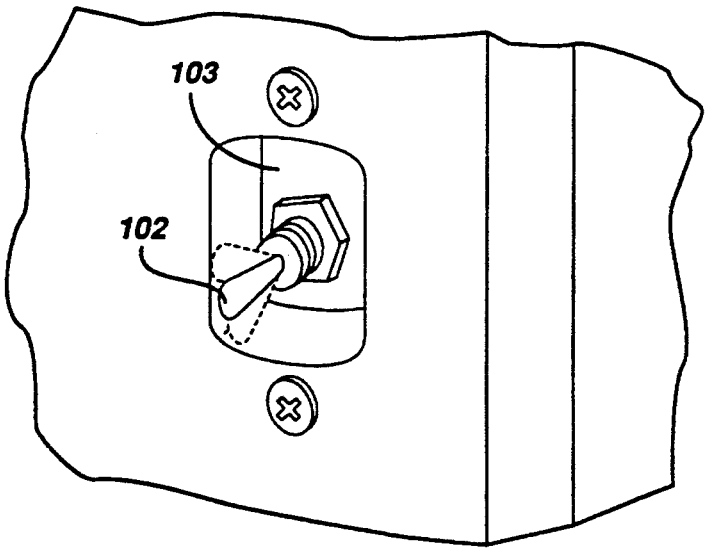
FIG. 8 is a perspective, partially in phantom, of a power switch according to the invention.

Power to the motor 70 is provided through a switch 102 which is preferably located at the front face 19 of the housing. The switch 102 can be of any suitable construction, such as a toggle switch. The switch 102 is preferably three-position (FIG. 8), providing for on, off and reverse operation. Reverse operation of the motor reverses the rotation of the crushing rollers, which is sometimes desired to remove jammed material between the rollers. The switch can be connected to the motor 70 through suitable wires 112, 114. A recess 103 can be provided for mounting the switch 102 to prevent accidental striking of the switch.

Figure 7:
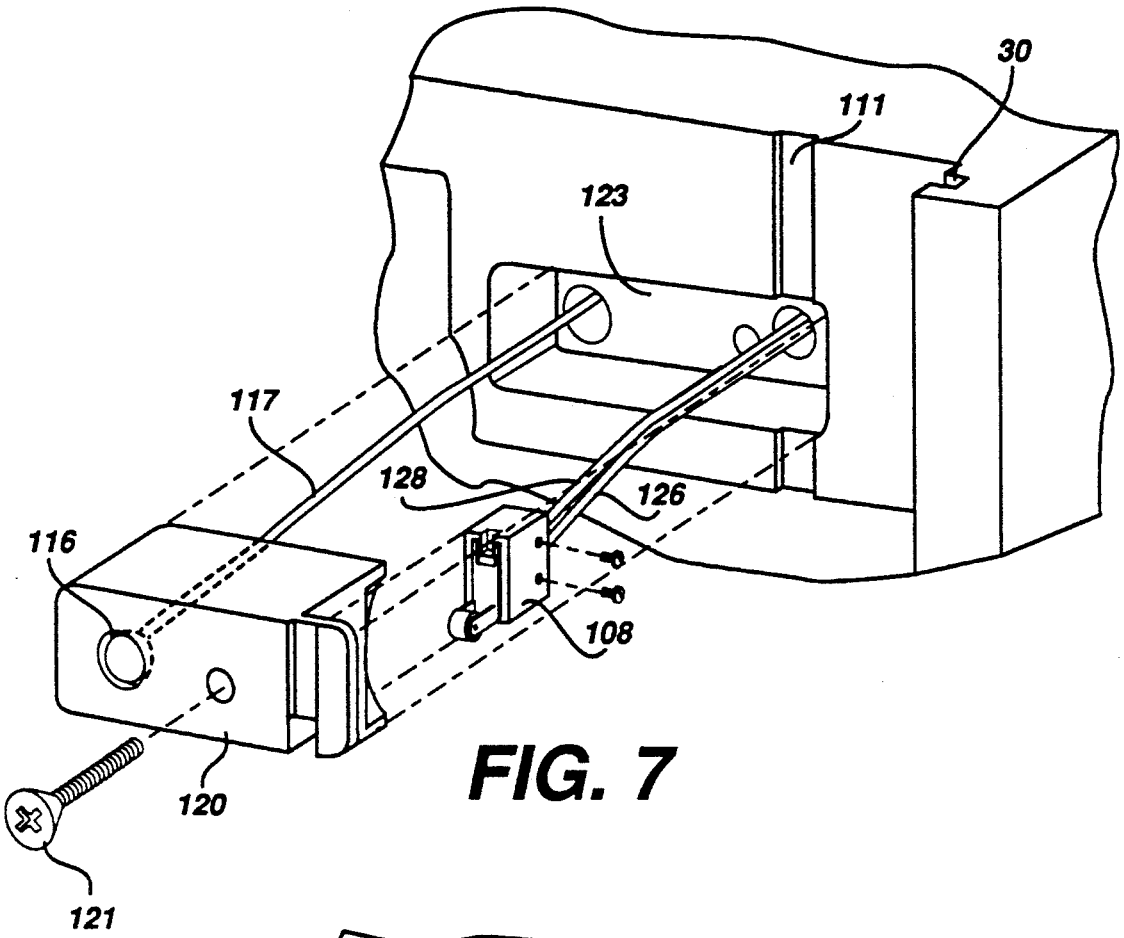
FIG. 7 is an exploded perspective of a safety switch according to the invention.

It is preferable that operation of the crushing rollers 14 halt whenever the cover 26 is opened or removed. A switch is preferably coupled to the motor 70 to automatically sense the opening or removal of the cover 26 and halt operation of the motor 70. A suitable switch 108 is coupled to the motor 70 through the wires 126, 128 and is connected so as to stop operation of the motor when the cover 26 has been moved to the open position (FIG. 7). The switch can be selected from any suitable construction. One such construction is the roller lever micro switch of the Tandy Corp. of Dallas Tex., Part No. 275017. A ramp surface 109 can be provided on an interior of the cover 26 to act on the lever switch 108 with movement of the cover 26 to halt operation of the extractor when the cover 26 is moved. A groove 111 can be provided in the housing for movement of the ramp 109. A pilot light 116 is connected so as to visually indicate operation of the extractor. The pilot light 116 with a connection 117 can be mounted with the switch 108 in a module 120 that can be secured to the housing 11 by a screw 121.

The housing 11 is preferably formed of cast aluminum. Casting allows mass production with little machining necessary for completion. Also, the cast design provides for few bends and crevices, which crevices accumulate food matter and are difficult to clean. An FDA approved polytetrafluoroethylene coating is preferably provided in the compartment 12. A baked finish such as Polane, manufactured by DeSoto Industrial Coatings, City of Industry, Calif., is preferably applied to the exterior of the housing. Suitable adjustable supports 134 are preferably provided. The rear panel 21 is preferably removable and includes ventilation openings 140.

This invention can be embodied in many other specific forms without departing from the spirit or essential attributes thereof. The number and specific design of the crushing rollers, for example, can be varied, as can the positioning of the rollers within the housing. Accordingly, reference should be had to the following claims, rather than to the foregoing description, as indicating the scope of the invention.

I claim:

1. A sugar cane juice extractor, comprising:

a plurality of spaced, crushing rollers, adjacent crushing rollers counter-rotating to form opposing pairs;

drive means for axially rotating said crushing rollers so as to crush sugar cane stalk which passes between opposing pairs of said rollers, thereby extracting juice from said sugar cane stalk, said crushing rollers being removably connected to said drive means;

said crushing rollers being enclosed within a housing, said housing comprising an opening positioned such that said crushing rollers may be detached from said drive means and removed from said housing through said opening, a closure movably positioned over said opening, and an entry port through which cane may be introduced into said housing and crushed by said crushing rollers;

said drive means comprising rotatable shafts extending into said housing, said crushing rollers being rotatably secured to and axially removable from said drive shafts.

2. The sugar cane juice extractor of claim 1, wherein said housing has an outlet for the removal of sugar cane juice and an exit port for the removal of cane pulp.

3. The sugar cane juice extractor of claim 1, wherein said closure is optically clear, thereby allowing observation of said rollers and the interior of said housing.

4. The sugar cane juice extractor of claim 3, wherein said closure is made of clear, rigid plastic.

5. The sugar cane juice extractor of claim 1, wherein said opening has at least two parallel opposing edges defining opposing grooves and wherein said closure is a panel slidably mounted in said grooves.

6. The sugar cane juice extractor of claim 1, wherein said drive means comprises shafts operatively connected to a motor, each crushing roller having a substantially axial opening adapted to mate with said shaft, and means for securing said crushing roller on said shaft.

7. The sugar cane juice extractor of claim 6, wherein said securing means comprises a key surface on each of said shafts, a matching slot being provided in each of said axial openings.

8. The sugar cane juice extractor of claim 6, further comprising spur gears interconnecting said shafts, such that rotation of one of said shafts transfers power to counter-rotate all other said shafts.

9. A sugar cane juice extractor, comprising:

a plurality of spaced, crushing rollers, adjacent rollers counter-rotating to define opposing pairs;

drive means for axially rotating said crushing rollers so as to crush sugar cane stalk which passes between opposing pairs of said rollers, thereby extracting juice from said sugar cane stalk, said crushing rollers being removably connected to said drive means;

said crushing rollers being enclosed within a housing, said housing comprising an opening positioned such that said crushing rollers may be detached from said drive means and removed from said housing through said opening, a closure movably positioned over said opening, and an entry port through which cane may be introduced into said housing and crushed by said crushing rollers;

a safety switch means for preventing rotation of said crushing rollers when said closure is not positioned fully over said opening.

10. A sugar cane juice extractor, comprising:

a plurality of spaced, crushing rollers, adjacent crushing rollers counter-rotating to define opposing pairs;

drive means for axially rotating said crushing rollers so as to crush sugar can stalk which passes between opposing pairs of said rollers, thereby extracting juice from said sugar cane stalk, said crushing rollers being removably connected to said drive means;

said crushing rollers being enclosed within a housing, said housing comprising an opening position such that said crushing rollers may be detached from said drive means and removed from said housing through said opening, a closure movably positioned over said opening, and an entry port through which cane may be introduced into said housing and crushed by said crushing rollers;

said housing being substantially manufactured from a single casting.

11. The sugar cane juice extractor of claim 10, wherein said housing comprises an interior juice extracting compartment, said juice extracting compartment of said housing being coated with polytetrafluoroethylene.

12. The sugar cane juice extractor of claim 10, wherein said casting defines a guide channel extending from said entry port to a position substantially adjacent said crushing rollers, for introduction of sugar cane and flavorings to said crushing rollers.

13. The sugar cane juice extractor of claim 12, comprising three crushing rollers forming two crushing pairs positioned such that a first crushing pair, nearest to said guide channel, counter-rotate to perform an initial crushing of cane entering through said entry channel and a second crushing pair, having one of said crushing rollers in common with said first crushing pair, counter-rotate to perform a final crushing of said cane, said sugar cane juice extractor comprising a waste channel, pulp leaving said second crushing pair being expelled into said waste channel.

14. The sugar cane juice extractor of claim 13 wherein the spacing between said crushing rollers in said first crushing pair is about 0.3 inches and the spacing between said crushing rollers in said second crushing pair is about 0.1 inches.

15. The sugar cane juice extractor of claim 10, wherein said housing comprises an interior juice extracting compartment, said juice extracting compartment of said housing being coated with a stick-resistant coating.

* * * * *